US005163576A

United States Patent [19]

Galer

[11] Patent Number: 5,163,576

[45] Date of Patent: Nov. 17, 1992

[54] LID AND CONTAINER ASSEMBLY INCORPORATING CAMMING LID APPLICATION STRUCTURE

[76] Inventor: Herbert W. Galer, 303 Channel Run, Washington, N.C. 27889

[21] Appl. No.: 868,043

[22] Filed: Apr. 14, 1992

Related U.S. Application Data

[63] Continuation-in-part of Ser. No. 719,141, Jun. 21, 1991.

[51] Int. Cl.[5] ..... B65D 39/00

[52] U.S. Cl. ..... 220/308; 220/306; 220/240; 215/270

[58] Field of Search ..... 220/308, 306, 357, 358, 220/355, 240; 215/270

[56] References Cited

U.S. PATENT DOCUMENTS

| | | | |
|---|---|---|---|
| 3,380,621 | 4/1968 | Rissberger, Jr. et al. | 220/357 |
| 3,664,544 | 5/1972 | Hammes | 220/308 |
| 4,166,548 | 9/1979 | Crisci | 220/308 |
| 4,877,150 | 10/1989 | Otto et al. | 220/308 X |
| 5,046,632 | 9/1991 | Bordner | 220/308 X |

*Primary Examiner*—Stephen Marcus
*Assistant Examiner*—Paul A. Schwarz

[57] ABSTRACT

A thermoplastic generally cylindrical container having a peripheral gasket in an outwardly-facing channel near the rim; a plurality of outwardly flared cam surfaces below the channel for stretching an inwardly facing terminus of the skirt of the lid to pass over the gasket as the lid is placed on the container to engage the underside of a ledge at the lower end of the cam surface.

4 Claims, 2 Drawing Sheets

LID AND CONTAINER ASSEMBLY INCORPORATING CAMMING LID APPLICATION STRUCTURE

RELATED APPLICATION

This application is a continuation-in-part of my copending application of the same title, filed Jun. 21, 1991, Ser. No. 07/719,141.

TECHNICAL FIELD

This invention relates to molded thermoplastic containers, and to a lid construction therefor which will meet the increasingly severe test requirements for transportation of hazardous materials, particularly those relating to drop tests and/or for internal pressure.

BACKGROUND OF THE INVENTION

Vendors, purchasers, consumers, and transporters of hazardous materials demand that their containers meet increasingly difficult tests. Typically, the tests are those defined by associations or regulatory bodies; a good example is the United Nations Specifications for the Transportation of Hazardous Materials, which emphasize particularly the internal pressure effects of volatile materials subjected to variable temperatures over long periods of time, and/or a drop test which may cause significant abrupt increases in pressure in a filled container. Internal forces caused by vapor pressure or severe impact may rupture, dislodge or distort the seal between the container and the lid in certain known and predictable ways.

Typically a sealed container filled with a volatile, high vapor pressure material, when subjected to increase in ambient temperature or when stored in a tropical climate or transported in closed vehicles will experience an increase in internal pressure and tend to cause a doming effect or a lifting of the center of the lid; this is especially so in the case of many containers of current design, which have a peripheral gasket around the top rim of the container itself, kept in place by contact inside a circumferential recess in vertical relation to the rim of the lid. While the conventional gasket placement achieves a good seal in normal usage, it is in a relatively weak and flexible portion of the assembly when the container is subjected to distortion by impact and internal pressure. The doming effect will distort the outer contour of the lid and cause a separation of the gasket and the lid, resulting in an opening and spillage or forceful spewing of the hazardous material. This effect has been partially overcome in the past through the use of a peripheral inwardly directed ledge on the lid and a complementary peripheral chime on the container; the lid including the gasket is snap-fitted onto the container so the ledge will make it difficult to lift the lid. Frequently, however, the sudden distortion of impact under the drop test and/or a time factored internal (vapor) pressure test will cause a separation and/or loosening of the lid.

It should also be noted by way of background that some of the limitations in the design of construction of the container-lid interface are due to the difficulty of removing a newly molded thermoplastic lid from a mold. Most especially, newly molded lids which have peripheral inwardly directed ledges made to contact the underside of peripheral chimes on the containers have been removed from the molds by stripper rings which stretch the thermoplastic outwardly so as to clear the larger dimensions of the mold. The dimensions of the inwardly directed ledges have been limited by the limits of elasticity of the thermoplastic. A mold construction for readily removing the perimeters of thermoplastic lids from mold cores which include peripheral protrusions into the lids is disclosed in my U.S. Pat. No. 4,777,004.

Accordingly, in designing a new thermoplastic lid which will cooperate with the container body in such a way as to pass the more stringent drop tests and other tests, one must take into consideration both the way the lid is made and the manner in which stresses are distributed in the filled container when it is subjected to the various tests for impact and internal pressure. As may be seen below, the seal effected by the gasket may be employed in such a way that it is not weakened by a doming effect of the lid.

SUMMARY OF THE INVENTION

I have invented a lid and container construction in which any doming effect of the lid caused by internal compressive forces will not only not result in a separation of the gasket and the lid, but will actually direct the compressive forces in a manner to improve the sealing between the gasket, the lid, and the rim of the container, and will also increase the pressure of the contact between the inside of the lid and the outside of the container. Moreover, my lid is readily made in a mold system having a peripheral segmented stripper ring for stripping the elastomeric thermoplastic from the mold such as described in U.S. Pat. No. 4,777,004.

In three major respects, my invention takes advantage of the fact that conventional thermoplastics such as polyethylene, polypropylene and other polyolefins, ABS, nylon and other thermoplastics such as many materials containing elastomeric additives, can be stretched or bent without damaging them. In spite of the fact that my lid includes at least one inwardly projecting peripheral flange for projecting underneath a peripheral ledge on the container, (1) the lid can be removed from a mold positively embodying the contour of the container, through the use of a system for molding as shown in my U.S. Pat. No. 4,777,004, and (2) the lid can be placed on the container by allowing the projecting peripheral flange to be stretched and expanded as it is placed on the container and passes over the container's peripheral ledge. A third point is that when internal pressure tends to cause an outward expansion of the container or particularly its upper portions, the peripheral gasket, being on the outside wall of the container rather than on the top of the rim, is stretched as well, causing it to adhere more tightly to the container and at the same time it forms a more tenacious seal with the lid because the expanding container tends to push it more tightly into the contour of the lid.

DETAILED DESCRIPTION OF THE INVENTION

My invention involves a particular construction of a thermoplastic lid and container, which will pass all reasonable drop tests, internal pressure tests and other impact, or internal expansive force tests. My lid is constructed in such a way that a doming effect on the lid caused by the upward exertion of pressure through a non-compressible or expanding material in the container will distort the lid to increase the degree of contact of the lid and gasket. This is accomplished in part by employing a lid having a central portion generally lower than the peripheral portions, which are distended to curve generally in a lip or inverted U over the rim of the container and form a peripheral skirt having at least one or more reinforcement rings in juxtaposition with peripheral ledges on the container; the top of the peripheral lip, or inverted U, of the lid is contoured on the inside of its leg or skirt to retain a peripheral elastomeric gasket around the outside edge of the container rim near the top thereof, and the container rim is complementarily contoured to form a channel for receiving the outer portion of the gasket. The seal is thus accomplished on an outwardly-directed surface of the gasket rather than an upper surface as in the conventional system. When pressure is exerted on the lid from inside the container, accordingly, the more or less vertical portions of the lid may be thus bent into a position which leverages the lip of the lid to urge the skirt, or outer leg of the inverted U, inwardly, thus increasing pressure on the gasket and the skirt/channel interface; in addition and since open head plastic pails are relatively elastic, internal pressure forces the open end of the pail outward which increases its diameter, further increasing the compressive force on the gasket.

My invention will be described in more detail with reference to the drawings, of which FIG. 1 is a side sectional view of a newly molded lid of my invention being removed from the mold;

Figure 1:
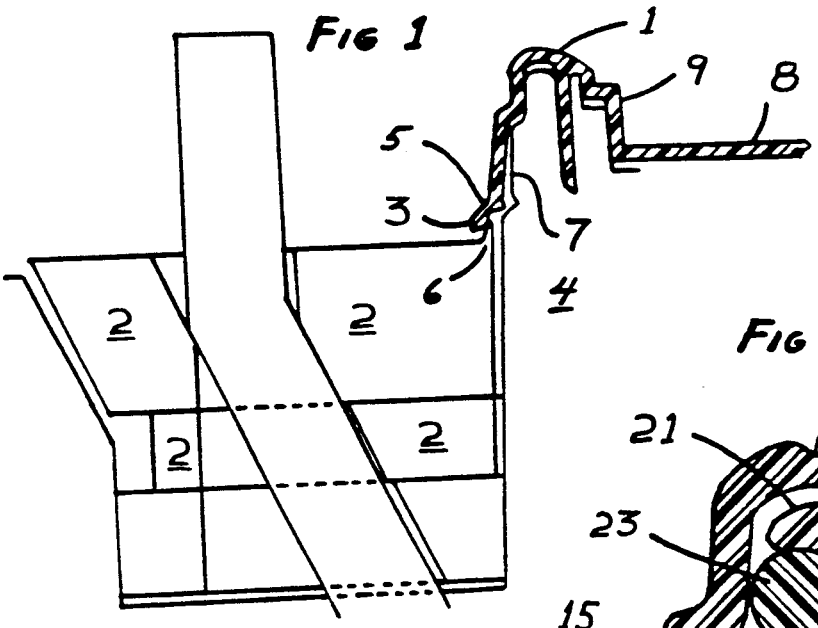

In FIG. 1, the newly molded lid 1 is shown in side section at the moment the stripper ring 2 is moved upwardly to engage the lowest point of the skirt 3 of the lid 1 after it has solidified in place on mold core 4. Portions of the mold which formed the upper and left side contours of lid 1 have been removed and are not shown. Only a portion of lid 1, which is seen in cross section, is shown; the lid 1 is generally circular, having a generally flat central portion shown partially at 8 and the opposite side of it is a mirror image of the view of FIG. 1. The problem is to remove the lid 1 from the mold Core 4 without damaging the undercut 5. This is accomplished by employing a segmented stripper ring 2 already in contact at extremity 6 with the lower end of the lowest point of skirt 3, as explained fully in my U.S. Pat. No. 4,777,004, which is incorporated herein by reference. Because of the slightly angular movement of stripper ring 2, extremity 6 of the segmented stripper ring 2 has the effect of drawing the lower points of the skirt 3 away from the surface 7 of the mold core 4, taking advantage of the elasticity of the thermoplastic lid to expand the diameter of skirt 3.

Figure 2:
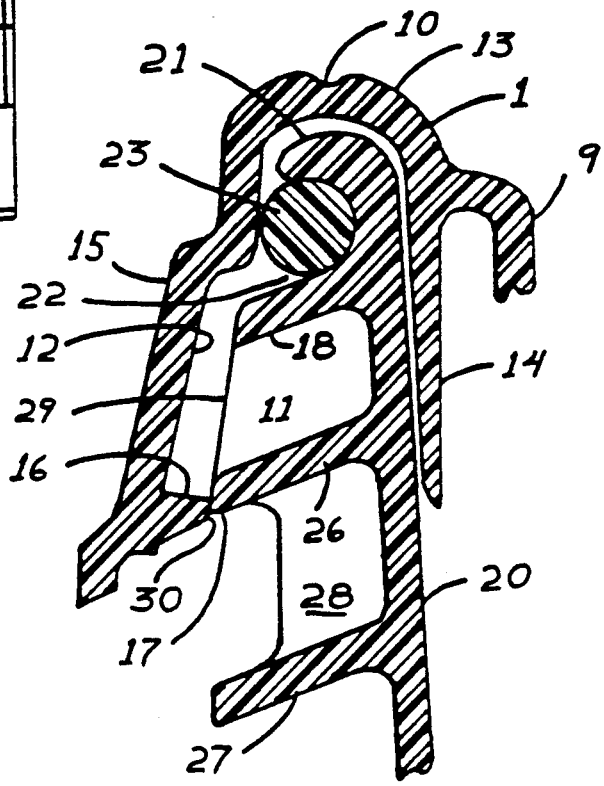
FIG. 2 shows the lid contacting the container during its placement on the container.

In FIG. 2, my preferred finished lid and container construction is shown in side section prior to actually sealing the lid. The lid 1 has a peripheral generally vertical connector 9, for the generally flat central portion 8, seen in FIG. 1, and an engaging section 13 generally in the shape of an inverted U; in a preferred form engaging section 13 may have a groove 10 which is intended to facilitate flexing at its top. The engaging section 13 comprises a generally flat (in section) internal leg 14 and an external leg 15. Ledges 18 and 26 On the container extend somewhat downwardly. The lower end of leg 15 flares outwardly; that is, the outward extension of external leg 15 is greater in its lowest portion. Correspondingly, the lower ledge 26 will extend further outwardly than the upper ledge 18. In the variation of my invention illustrated in FIG. 2, ledge 27 is shown also extending downwardly and the profile of optional reinforcing rib 28 is also shown. On the inside surface of leg 15 near its extremity is engaging surface 16 which, as will be seen in FIGS. 5 and 6, engages and locks with surface 17. Engaging surface 16 is on the lower end of channel 12. The container wall 20 is generally cylindrical, except for the ledges 18 and reinforcing ribs 11 and 28, but has just below its rim 21 a peripheral gasket recess 22 for holding a resilient peripheral gasket 23. The gasket recess 22 is oriented outwardly from rim 21, and gasket 23 is compressed inwardly by the top portion of external leg 15 of lid 1.

In the preferred embodiment of FIG. 2, the lower ledge 26 may extend outwardly about 0.100 inch to about 0.160 inch beyond ledge 18 in a container having a diameter of 12 inches.

Figure 5:
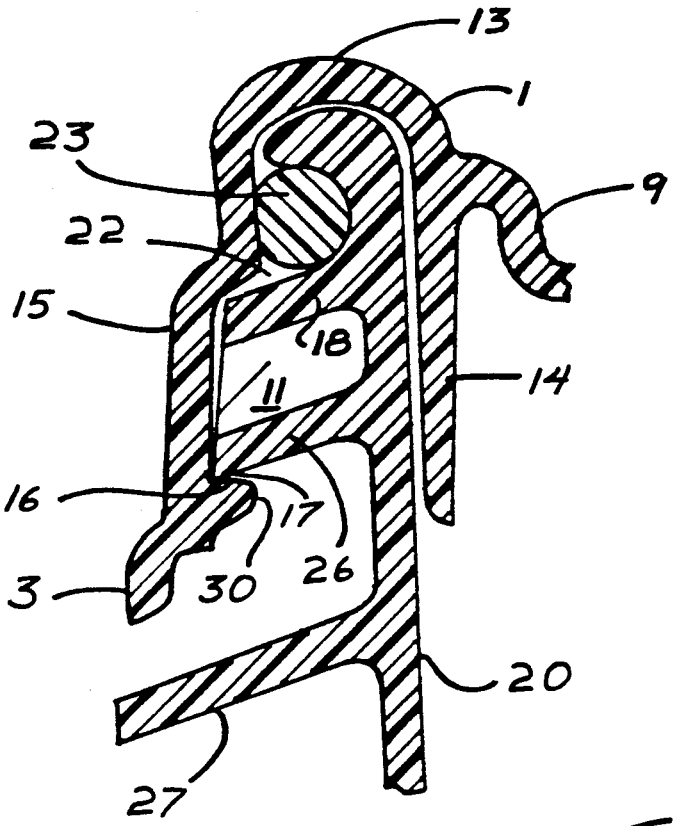
FIG. 5 is an assembly of the present invention, showing the lid, gasket and container in place prior to the application of internal pressure.
Figure 6:
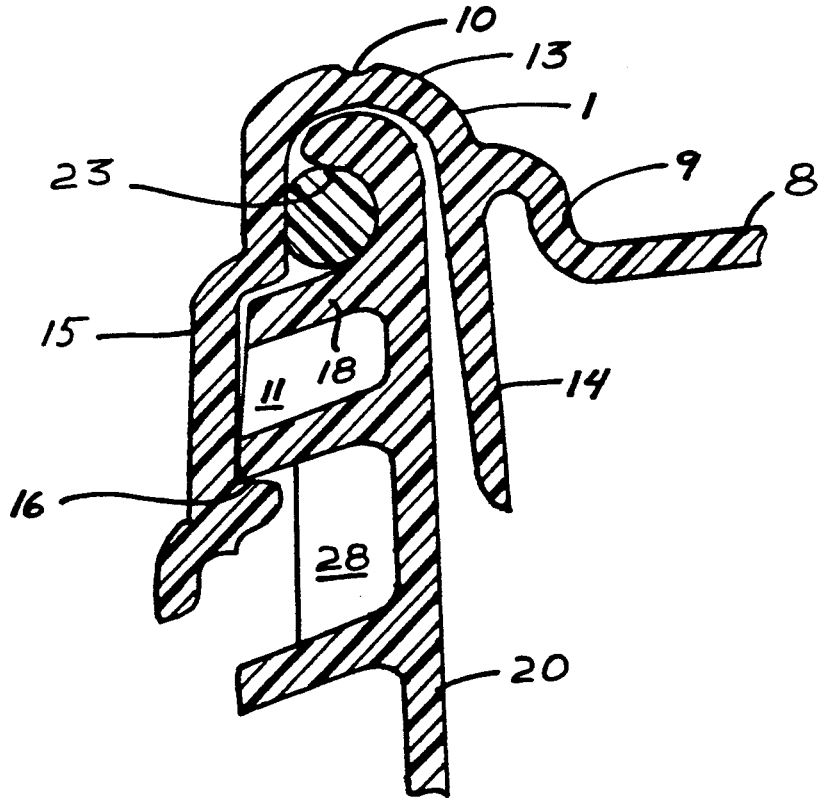
FIG. 6 is the assembly of FIG. 5 in the instant following application of internal pressure to the underside of the lid during a drop test, showing the effect on the seal and the integrity of the closure.

In FIG. 2, the lid 1 is in the process of placement on the container. An important feature of my invention is the cam surfaces 29 on reinforcing ribs 11. Cam surface 29 on the under side of extremity 3 is shown in contact with terminus 30 on extremity 3. As lid 1 is forced downward the contact of terminus 30 with cam surface 29 gradually stretches and spreads the lower diameter of leg 15 until the terminus 30 snaps into place as shown in FIGS. 5 and 6. This permits the upper portion of leg 15 to clear gasket 23, thus avoiding any unwanted displacement of the gasket 23.

Figure 3:
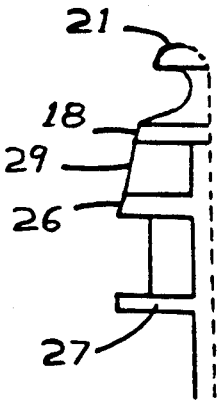
FIG. 3 is a simple profile of the upper portion of the container.
Figure 4:
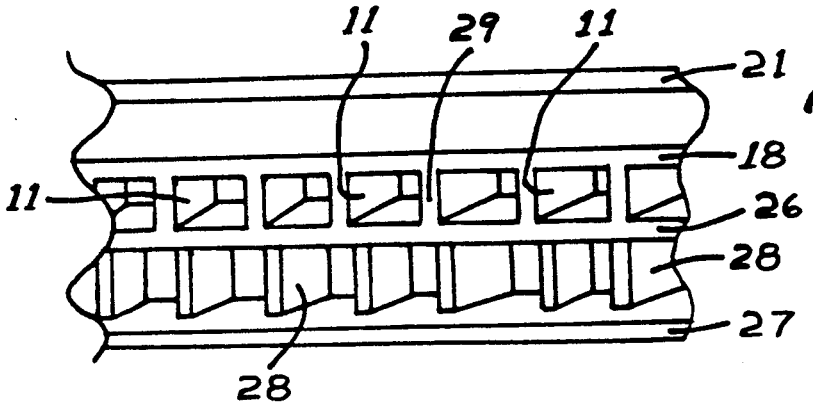
FIG. 4 is an elevational view of a portion of the container showing vertical reinforcement ribs.

FIG. 3 shows a profile of the upper part of the container, having the same dimensions in illustration as FIG. 4. In FIGS. 3 and 4, recess 22 is formed immediately above ledge 18, which has underneath it a plurality of reinforcing ribs 11 extending the full dimension of ledge 18 so that its outer surface Can form cam surface 29. Cam surface 29 is seen to extend downwardly at a slight angle to ledge 26, which in turn may have vertical reinforcing ribs 28.

FIG. 5 shows in side section the normal position of the lid 1 on the closed container. It should be noted particularly that the gasket 23 is compressed to make a good seal and engaging surfaces 16 and 17 are in close contact. While the clearance between leg 15 and the outside of ledge 18 is preferably designed into the dimensions to further prevent the possibility of contact between leg 15 and gasket 23 as leg 15 passes over it. I prefer also that the outside diameter of ledge 26 be slightly greater than the inside diameter of leg 15 where surface 16 extends inwardly, so that, when leg 15 snaps into place as shown it is still under tension, i.e. in an unrelaxed state.

In FIG. 6, it will be noted that the lid 1 has been somewhat distorted, having been urged upward by the contents of the container due to expansion or a sudden impact and/or internal pressure. Since the lid 1, being made of thermoplastic material such as polyethylene or polypropylene, and particularly the normally generally flat portion s, is urged upwardly, the vertical connector 9 is also distorted so that it tends, in this view, to rotate counterclockwise, while exerting a leveraging effect on the external leg 15, urging it toward container wall 20. Thus the intimate contact of the leg 15 and ledges 18 and 26 is made more intense and also the upper portion of external leg 15 exerts even more compression on gasket 23 and on the engaging surfaces 16 and 17. This is in contrast to the conventional gasket configuration wherein the gasket is on top of the rim, nested in the top curve of the inverted U of the lid. In those constructions, the leveraging of the inverted U often results in a space above the gasket, permitting hazardous material to jet, spill or otherwise escape. In my construction, the same type of distortion of the lid results in an even tighter seal. It will be noted also that in my construction the stress is relieved somewhat by groove to which permits ready flexing, in FIG. 6 in a counterclockwise direction caused by internal pressure, and, in FIG. 2 in a clockwise direction when the lid is in the process of closure.

More than one channel on the container may mate with a corresponding plurality of channels on the lid, as will be apparent to persons skilled in the art. Where this is the case the lower ledge will still be of greater diameter than the upper ones, as indicated elsewhere herein.

My lid may be made in a mold and removed from the mold in the manner taught in my U.S. Pat. No. 4,777,004.

I claim:

1. A thermoplastic lid and container assembly comprising (a) a lid having a generally flat central portion, a peripheral sealing portion in the shape generally of an inverted U extending above said flat central portion and having an internal leg and an outer leg, said outer leg having at least one internal channel for receiving a complementary ledge on a container wall (b) a generally cylindrical container having a rim, an upper external ledge and a lower external ledge said ledges extending outwardly, said lower external ledge extending outwardly slightly farther than said upper external ledge and having a lower surface adapted to engage with a lower surface of said internal channel when said lid is on said container, said container having a peripheral gasket channel near its rim and on the outside thereof for receiving a peripheral compressible gasket, and a plurality of ribs between said upper and lower external ledges and having external surfaces extending from the outermost edge of said upper ledge to the outermost edge of said lower ledge, and (c) a peripheral gasket for said gasket channel; whereby, during placement of said lid on said container, said external surfaces of said ribs cause said outer leg of said lid to expand outwardly to clear said gasket, and whereby, after placement of the lid on the container, the lower surface of said lower external ledge engages the lower surface of said internal channel and said gasket is compressed inwardly with respect to said container by said outer leg.

2. A lid and container assembly of claim 1 wherein said lower ledge extends slightly downwardly.

3. The lid and container assembly of claim 1 wherein said generally flat central portion of said lid connects to said internal leg of said peripheral sealing portion, whereby, when said container and said lid assembly are stressed by internal pressure, a doming effect on said generally flat central portion will exert a leverage on said peripheral sealing portion to further compress said gasket by urging said outer leg thereof in an inward direction.

4. The lid and container assembly of claim 1 wherein, when said lower surface of said internal channel engages said lower surface of said lower external ledge of said container, said lower surface of said internal channel is underneath said lower surface of said lower external ledge of said container.

* * * * *